United States Patent [19]

Hovnanian

[11] 4,036,501

[45] * July 19, 1977

[54] BOARD GAME APPARATUS

[76] Inventor: John Hovnanian, 30 Hancock St. Arlington, Mass. 02174

[ * ] Notice: The portion of the term of this patent subsequent to Aug. 5, 1992, has been disclaimed.

[21] Appl. No.: 616,270

[22] Filed: Sept. 24, 1975

[51] Int. Cl.[2] ..... A63F 3/00

[52] U.S. Cl. ..... 273/131 K; 273/137 R

[58] Field of Search ..... 273/131

[56] References Cited

U.S. PATENT DOCUMENTS

| | | | |
|---|---|---|---|
| 665,505 | 1/1901 | Buttgenbach | 273/131 K |
| 1,016,187 | 1/1912 | Vacek | 273/131 K |
| 1,282,964 | 10/1918 | Simcox | 273/131 K |
| 1,624,970 | 4/1927 | Owye | 273/131 K |
| 3,897,953 | 8/1975 | Hovnanian | 273/131 AB |

*Primary Examiner*—Delbert B. Lowe

[57] ABSTRACT

A board game apparatus for two players comprising a board having a main playing area, and an outer perimeter which is an exclusive passage for the exclusive use of a single designated piece, one for each player, L-shaped simulated barriers and goal zones, and a plurality of game pieces divided equally between the players. The object of the game is one of strategic maneuver and interplay of the game pieces between the two players, as permitted by the rules, moving the pieces generally forward toward predetermined goals, utilizing the advantages of the outer perimeter for the exclusive use of the said designated piece.

1 Claim, 2 Drawing Figures

BOARD GAME APPARATUS

This invention relates to further improvements in a board game apparatus, a chess-type game, intended particularly to provide an inexpensive game of skill, involving mental strategy.

The primary object of the game is the provision of a game board or playing area wherein two opposing players may manipulate their play pieces in such a way as to generally advance their own play pieces toward a goal, and generally at the same time to retard the advance of the opponent, and whenever possible to eliminate opposing play pieces. The object also generally at the same time is to utilize to its maximum advantage the benefits of a novel and distinct innovation: an exclusive passage for the exclusive use of a designated playing piece, one for each player, in accordance with predetermined rules of play.

Another object of the present invention is to provide an intellectual game which may be played by two and has a wide range of interest for young children as well as adults.

Although the overall description will be generally detailed in the outline of the different aspects of this board game, the game as played by two players is relatively simple in concept, as compared with chess. The intention is to make available to interested players a provocative and stimulating game, particularly with the new innovation of the exclusive passage for exclusive use of the designated piece.

The drawing accompanying and forming part of the specification illustrates a present practical embodiment of the invention which includes the said novel exclusive passage for the use of an exclusive single designated playing piece, one for each player.

Figure 1:
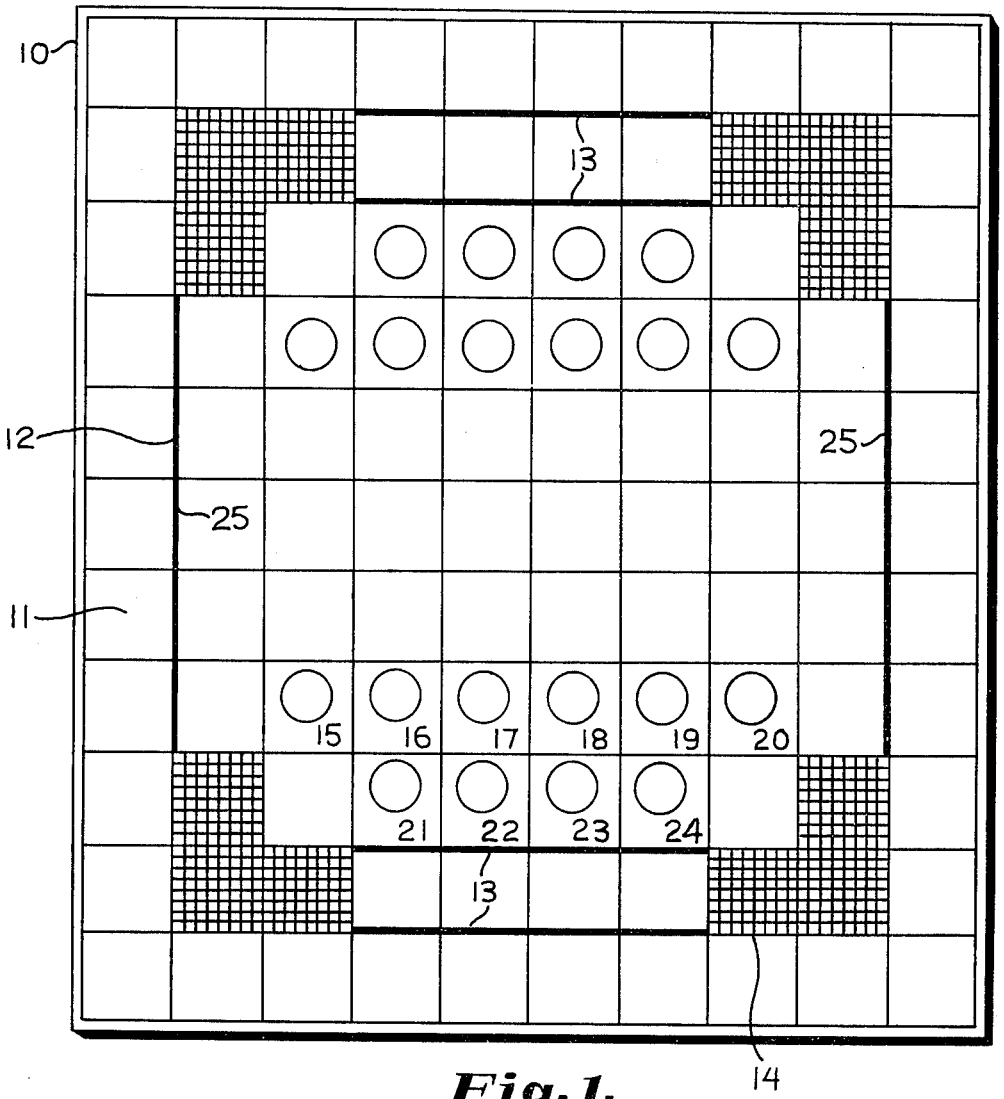
FIG. 1 is a plan view of the game board in its preffered form, showing the exclusive passage and with the game pieces shown in the positions they occupy at the commencement of a game.

The design of the board is shown in FIG. 1, and this may be mounted on any suitable support, as for example, heavy paper, cardboard, a wooden board or any other similar support. The game apparatus of the present invention may be described as follows with reference to FIG. 1; a playing board 10 is divided generally into four areas; (a) the outer perimeter 11, (b) the main arena 12, (c) goal zones 13 and (d) L-shaped non-playing simulated barriers 14.

The exclusive passage or course 11 extends around the outer perimeter of the game board, forming 38 marginal squares. The main playing area 12 occupies the inner playing area, being directly adjacent to the outer passage on the two sides and being adjacent to the goal zones on the top and bottom of the board and adjacent the barriers in four places, forming a total of 52 squares. The two goal zones 13 are directly adjacent and between the outer passage on one side and the main playing area on the other side, each goal forming four squares side by side with both goals occupying and totaling 8 squares. The simulated barriers 14 are L-shaped and are four in number, forming the inward corners of the outer passage with each barrier occupying the equivalent of three squares for a total of 12 squares. Although the barriers are non-square in shape, they occupy the equivalent of three squares each. The game pieces being twenty in total, are divided equally, ten for each player, respectively.

Figure 2:
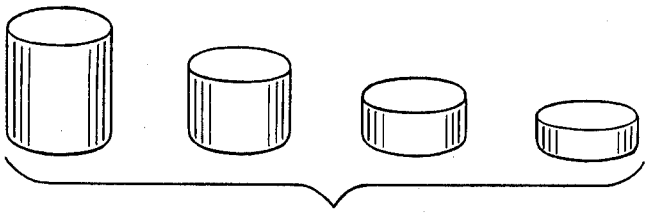
FIG. 2 is a view in perspective of the four basic types of game pieces used, which are shaped in representation of their degrees of relative importance.

With continued reference to FIG. 1, the ten pieces are referred to in the numbered squares are as follows; king 22, queen 18, jack 16, guards 15, 17, 19, 20, 21, 23 and 24, with the king having the prerogative of being the designated piece with the exclusive right to use the exclusive passage. The physical make-up of the four basic pieces, king, queen, jack and guards, can vary in size and shape as shown in FIG. 2, with the king being the largest in size, the queen being of somewhat smaller size, the jack being smaller than the queen and the guards being the smallest in size. This is given only as a preferred example, since the relative differences between the basic pieces also can be made by the use of either graphic markings or differenciating shapes, or by the use of color symbols.

With continued reference to the drawing, the playing face of the board has a number of mutually perpendicular, intersecting grid lines extending parallel to the edges of the board, thereby forming a series of individually distinct playing spaces which are arranged in a generally uniform pattern over the entire playing area of the board, including the central playing area, the goal zones, and the exclusive passage. The simulated barriers 14 are in each corner of the central playing area 12, forming the inward corners of the exclusive passage 11, leaving the exclusive passage itself unobstructed. Each of the four simulated barriers occupy an area generally equivalent to three playing squares, thereby leaving an entrance or exit for the exclusive use of the kind, through the goal zones 13, or along the sides 25, to or from the central playing area, it being the designated piece, either to move into or out of the exclusive passage. The goal zones 13 are accessible to the designated piece for any movement, either through said goal zones or within said goal zones. Each goal zone may be defined in any convenient way. In the drawing for example, each goal zone is defined by heavy lines 13, which extend along certain of the grid lines between the barriers. The side openings 25 are defined by heavy grid lines, extending between the barriers.

The board is checkered and lined for color.

The exclusive passage 11 forms a continuous passage or course extending about the perimeter of the game board. Both opposing kings have access of movement throughout the said exclusive passage on all sides of the board. This passage permits the designated piece, the king, the opportunity of, within a minimum number of moves, being in position to attack opposing pieces from either of the two sides 25 of the board, or from the rear 13, with the singular advantage of being itself protected while attacking from this form of sanctuary, the exclusive passage. Once the king moves into an advantageous position in the exclusive passage, the king can strike into the central playing area to remove an opposing piece and then, on the next move, to retire back into this sanctuary. However, when moving into the central playing area, the king becomes vulnerable, as will be more apparent further in this description.

The rules of the game may provide for generally fixed movements for the game pieces. The king, being the primary or designated piece, has the greatest range of movement. Only the king has the prerogative of moving into the exclusive passage. Once in the passage, he can move either one or more spaces at a time or as many spaces as exist in the outer perimeter on a given move.

The king can also play in the central playing area, again having the prerogative of moving one or more spaces on a given move, and if no pieces obstruct, and as an example, he is permitted to move from the outer perimeter on one side, through the central playing area to the outer perimeter on the opposite side. Therefore the king, when no other pieces obstruct, has the option of moving in any direction as many spaces as the board permits, from border to border, and can take opposing pieces from any direction. The queen moves and takes pieces in any direction one or more spaces or as many spaces as the boundary of the central playing area permits. The jack moves and takes pieces horizontally or vertically one or more spaces or as many spaces as the boundary of the central playing area permits, also taking pieces moving one space diagonally. As was stated above, all pieces are restricted to the central playing area, with the one exception being the kings, one from each side, who are permitted to play in both the central playing area and the outer perimeter. The guards are restricted to one or two spaces at a time, either forward vertically, forward diagonally, or one space sideways. In any case the guard cannot move backward, but takes opposing pieces diagonally only. The guard is permitted to jump over its own pieces.

Generally there are two ways in which a player can be declared the winner of the game. (1) By eliminating the queen or (2) by advancing and maneuvering one of the seven guards and thereby gaining access and entering into the opposing marked goal zone 13. However, it must not be in a position to be taken on the opponent's next move. If neither of the two ways is accomplished, the game becomes at that point a tie, as the rules may provide.

To continue, a further description of how the king may be played, particularly in relation to the exclusive passage. The king in one play can move backward through his own goal zone area and into the passage. Once in this sanctuary the king has the range, on a given play, to move as many spaces in the passage as exist in the passage. In the passage he can be placed strategically, and then, on subsequent moves, move through the center openings 25 facing the central playing area, or from the rear of opponent 13. From this position the king can attack vulnerable and unprotected opposing pieces. With this in mind, and as an example of how to protect oneself generally, the play pieces in the central playing area may be protected as follows; a guard moving forward one or two spaces has the immediate protection of a piece situated diagonally and directly behind, and other similar moves may be made for protection depending on the position of the other pieces, as from time to time the king, queen and jack may be used for protecting its own pieces. It is this interplay of game pieces that in turn makes a piece vulnerable at times and the attempts to protect it, and the further danger or advantage of a free-wheeling king moving with greater freedom and flexibility, who can attack from any direction with a minimum number of moves, that makes the game provocative by nature. Or if the strategy of a particular situation dictates, the king may remain by choice in the central playing area, either to protect its pieces, or force advantages left by a weakened opponent. The description of the king movements is only for example and not the full extent of the different situations the king may encounter. As stated previously, the king piece becomes vulnerable as any other piece while remaining in the main playing area. Because of the opportunities afforded by the passage, either as a sanctuary or as a means of strategic maneuvering, the king will attempt to take maximum advantage of his prerogatives as being the designated piece in relation to this sanctuary.

The object of the game becomes one of strategic maneuver and interplay of the game pieces between the two players, utilizing as far as possible all the advantages that the three basic game pieces and their potential movements may have under the rules. The game pieces for each player are generally moved forward, toward predetermined goals, eliminating opposing game pieces when the opportunities arise, and generally at the same time making attempts to block or retard the progress of the opposing pieces, also generally at the same time utilizing the exclusive passage, the outer perimeter, to its fullest practical extent.

Other objects, features and advantages of the present invention will become more apparent as one plays the game and becomes more versed and adept after each succeeding game.

Having thus described the invention, it is to be understood that although specific terms may have been used in the description, they are used in the generic and descriptive sense and not for the purposes of limitation, the scope of the invention being set forth in the following claim.

I claim:

1. A board game apparatus comprising a board and two sets of playing pieces, each set consisting of a single large piece, a single piece of smaller size, another single piece of smaller size than the aforementioned piece, and 7 pieces smaller than the last mentioned piece; said board having on its surface two sets of lines parallel to the sides of the board, the lines of one set being perpendicular to those of the other set, whereby 110 squares of equal size are provided, 38 of said squares forming a continuous path around the periphery of the board, the remaining squares being within said path and forming a major playing area, having at each of its corners an area equivalent in size and shape to three squares, said areas being of distinctive appearance and forming an L-shaped figure, two rows of four squares each between legs of the L-shaped figures and adjacent the inside top and bottom edges of the continuous path, the remaining 52 squares being arranged in seven rows, the uppermost and lowermost rows each having six squares and the five central rows each having eight squares.

* * * * *